US006253936B1

(12) United States Patent
Kong

(10) Patent No.: US 6,253,936 B1
(45) Date of Patent: Jul. 3, 2001

(54) DRINK DISPENSER FOR COLLAPSIBLE LIQUID CONTAINERS, AND RELATED METHOD

(76) Inventor: Carl Cheung Tung Kong, 6122 Whittier Blvd., Los Angeles, CA (US) 90022

( * ) Notice: Subject to any disclaimer, the term of this patent is extended or adjusted under 35 U.S.C. 154(b) by 0 days.

(21) Appl. No.: 09/478,964

(22) Filed: Jan. 6, 2000

Related U.S. Application Data

(63) Continuation of application No. 09/037,239, filed on Mar. 9, 1998, now abandoned.

(51) Int. Cl.[7] ..... A61J 9/00; A61J 11/00; A61J 9/04

(52) U.S. Cl. ..... 215/11.3; 215/11.1; 215/11.4; 215/11.5; 215/386; 215/388

(58) Field of Search ..... 215/11.1, 11.4, 215/11.3, 11.5, 388, 386

(56) References Cited

U.S. PATENT DOCUMENTS

| | | | |
|---|---|---|---|
| 3,780 | | 10/1844 | Dupy . |
| 159,197 | | 1/1875 | Mason . |
| 177,185 | | 5/1876 | Whitney . |
| 224,557 | | 2/1880 | Potter . |
| 227,075 | | 4/1880 | Thompson . |
| 234,224 | | 11/1880 | Barton . |
| 244,181 | | 7/1881 | Carpenter . |
| 253,014 | | 1/1882 | Day . |
| 275,288 | | 4/1883 | Thomas . |
| 279,935 | | 6/1883 | Glattsteine . |
| 280,656 | | 7/1883 | Morris . |
| 323,597 | | 8/1885 | Prime . |
| 468,759 | | 2/1892 | Bobrick . |
| 554,071 | * | 2/1896 | Matzen ..... 215/11.4 X |
| 593,830 | | 11/1897 | Borgenschild . |
| 682,464 | | 9/1901 | Graham-Yooll . |
| 2,469,489 | | 5/1949 | Allen et al. . |
| 2,520,335 | * | 8/1950 | Piazze ..... 215/11.4 |
| 2,594,114 | | 4/1952 | Baracate . |
| 2,655,279 | | 10/1953 | Wolf . |
| 2,680,441 | | 6/1954 | Krammer . |
| 2,756,740 | | 7/1956 | Deane . |
| 2,760,664 | | 8/1956 | D'Amico et al. . |
| 2,767,871 | | 10/1956 | Shapiro . |
| 2,826,324 | | 3/1958 | Hoag . |
| 2,836,321 | | 5/1958 | Soltesz et al. . |

(List continued on next page.)

FOREIGN PATENT DOCUMENTS

| | | | |
|---|---|---|---|
| 874/36 | | 3/1936 | (AU) . |
| 0610669 | * | 9/1926 | (FR) . |
| 610669 | * | 9/1926 | (FR) ..... 215/11.4 |
| 2067416 | | 7/1981 | (GB) . |
| 2131301 | | 6/1984 | (GB) . |
| 2181958 | | 5/1987 | (GB) . |
| 2220363 | | 10/1990 | (GB) . |
| 2254999 | | 10/1992 | (GB) . |
| 1699462 | | 9/1989 | (SU) . |

*Primary Examiner*—Allan N. Shoap
*Assistant Examiner*—Tri M. Mai
(74) *Attorney, Agent, or Firm*—Kelly Bauersfeld Lowry & Kelley, LLP

(57) ABSTRACT

A drink dispenser includes a dispenser body having an opening which permits passage of a fluid to be consumed therethrough, a rigid guide tube extending from the body opening, and a flexible fluid container which is supported relative to the guide tube. The flexible fluid container is adapted to extend away from the guide tube relative to the body opening when filled with the fluid to be consumed, and fully collapse into the guide tube as the fluid is withdrawn therefrom. A mouthpiece is provided which is in fluid flow communication with fluid contained within the flexible fluid container, and a valve prevents air-flow from the mouthpiece into the flexible fluid container.

16 Claims, 4 Drawing Sheets

U.S. PATENT DOCUMENTS

| | | | | |
|---|---|---|---|---|
| 2,846,103 | | 8/1958 | Maxwell . | |
| 2,876,113 | * | 3/1959 | Barton | 215/11.4 |
| 2,954,030 | | 9/1960 | Jozwiak . | |
| 2,996,207 | * | 8/1961 | Witz | 215/11.4 |
| 3,044,650 | | 7/1962 | Oltion et al. . | |
| 3,059,797 | | 10/1962 | Wilkinson et al. . | |
| 3,065,873 | | 11/1962 | Plate . | |
| 3,071,272 | | 1/1963 | Doner . | |
| 3,076,574 | | 2/1963 | Woodbury, Jr. . | |
| 3,126,116 | | 3/1964 | Clinehens . | |
| 3,134,494 | * | 5/1964 | Quinn | 215/11.3 X |
| 3,146,904 | | 9/1964 | Hansen et al. . | |
| 3,171,571 | | 3/1965 | Daniels . | |
| 3,173,566 | | 3/1965 | Talbert . | |
| 3,204,855 | | 9/1965 | Boynton et al. . | |
| 3,232,467 | * | 2/1966 | Barton | 215/11.4 |
| 3,243,069 | | 3/1966 | Duerme . | |
| 3,247,360 | | 4/1966 | Ponder . | |
| 3,346,133 | | 10/1967 | Herdman . | |
| 3,441,160 | | 4/1969 | Levy . | |
| 3,645,414 | | 2/1972 | Barr . | |
| 3,648,873 | | 3/1972 | Grobbel . | |
| 3,651,973 | * | 3/1972 | Yamauchi | 215/11.3 |
| 3,661,288 | | 5/1972 | Noll . | |
| 3,704,803 | | 12/1972 | Ponder . | |
| 3,770,154 | | 11/1973 | Johnson . | |
| 3,946,888 | * | 3/1976 | Tonkin . | |
| 3,955,698 | | 5/1976 | Hammer . | |
| 4,153,170 | | 5/1979 | Aquarian . | |
| 4,241,768 | | 12/1980 | Keller et al. . | |
| 4,301,934 | | 11/1981 | Forestal . | |
| 4,339,046 | | 7/1982 | Coen . | |
| 4,463,859 | | 8/1984 | Greene . | |
| 4,615,457 | | 10/1986 | Harding . | |
| 4,657,151 | | 4/1987 | Cabernoch . | |
| 4,684,032 | | 8/1987 | Tsay . | |
| 4,726,479 | | 2/1988 | Tsai . | |
| 4,754,887 | | 7/1988 | Ou . | |
| 4,796,767 | | 1/1989 | McKeown . | |
| 4,815,615 | * | 3/1989 | Phlaphongphanich | 215/11.3 |
| 4,821,896 | | 4/1989 | Cheng . | |
| 4,830,226 | | 5/1989 | Kong . | |
| 4,880,125 | | 11/1989 | LeBeau . | |
| 4,898,290 | | 2/1990 | Cueto . | |
| 4,925,042 | | 5/1990 | Chong . | |
| 4,969,564 | | 11/1990 | Cohen et al. . | |
| 4,979,629 | | 12/1990 | Askerneese . | |
| 5,105,956 | | 4/1992 | Tarng-Lin . | |
| 5,109,996 | | 5/1992 | Sullivan . | |
| 5,211,298 | | 5/1993 | Bloch . | |
| 5,301,825 | | 4/1994 | Di Scala et al. . | |
| 5,791,503 | * | 8/1998 | Lyons | 215/11.5 |

* cited by examiner

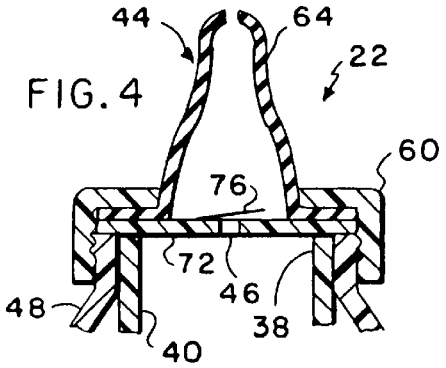
FIG. 4
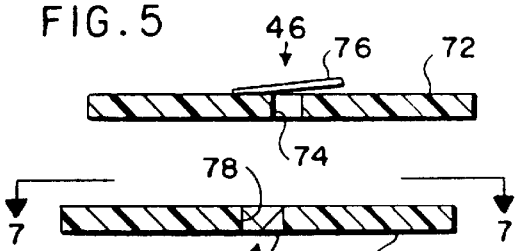
FIG. 5
FIG. 6
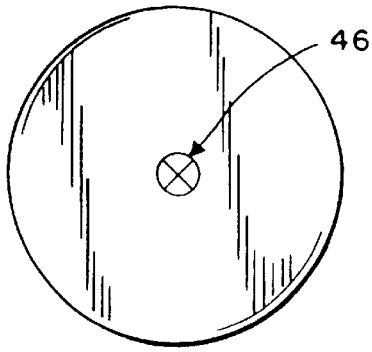
FIG. 7
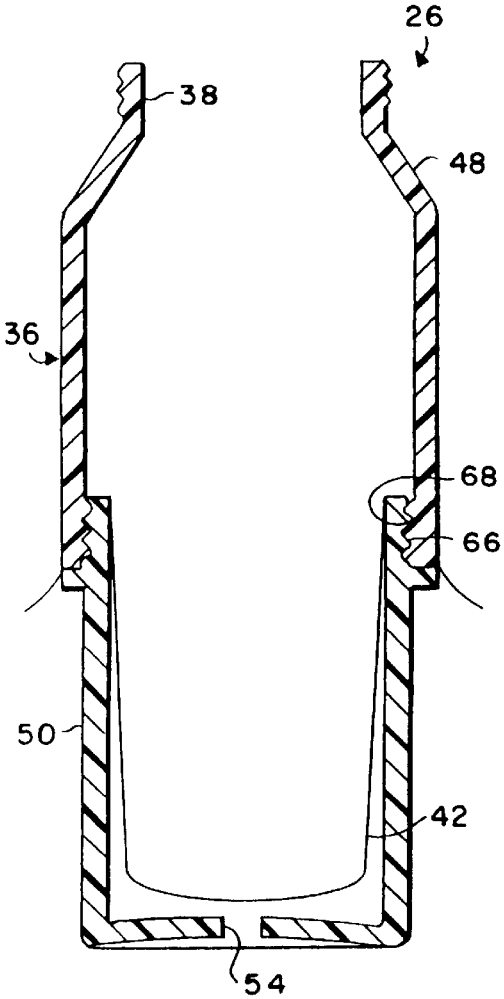
FIG. 9
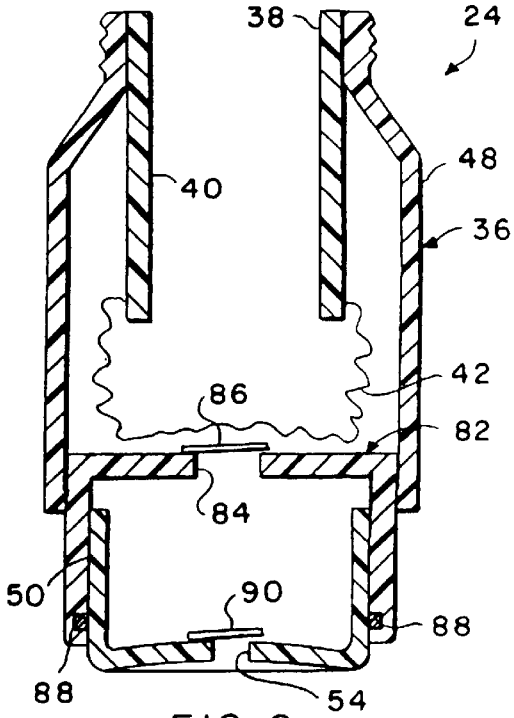
FIG. 8

DRINK DISPENSER FOR COLLAPSIBLE LIQUID CONTAINERS, AND RELATED METHOD

RELATED APPLICATION

This application is a continuation of application Ser. No. 09/037,239, filed Mar. 9, 1998 now ABN.

BACKGROUND OF THE INVENTION

This invention relates generally to drink dispensers, including nursing bottles for infants. More specifically, the present invention relates to drink dispensers which incorporate a collapsible plastic bag to hold a fluid in the dispenser, and a means for expelling air from the collapsible bag so that only the liquid remains for drinking. Moreover, the present invention relates to an improved mouthpiece or nipple to facilitate suction withdrawal of liquid from the drink dispenser.

Nursing bottles for infants are generally known in the art and typically comprise a resilient nipple mounted onto a cap or neck ring which is adapted in turn for mounting onto a bottle containing a selected beverage or food product in liquid form for an infant. The resilient nipple comprises a soft and collapsible mouthpiece which is manipulated by the infant with an alternating collapsing and expansion motion in combination with a sucking action to draw the liquid contents of the bottle through a nipple port. Nursing bottles of this standard type must be held in an inverted or substantially inverted position during use, to ensure fluid flow communication of the bottle contents to the resilient nipple. Further, such conventional bottles naturally fill with air as the infant drinks the liquid. In turn, the feeding infant tends to swallow some of the air, causing indigestion.

As an improvement on this long existing configuration, a newer generation of baby nursing bottles consists of a polymeric cylinder into which a collapsible plastic bag can be positioned. The plastic bag is usually secured at the top of the cylinder by a neck ring or the like. The milk, formula or other liquid is then added to the bag rather than to the cylinder or bottle itself. When topped with the appropriate nipple assembly, this arrangement desirably provides a system under which the bag gradually collapses as the infant feeds from the liquid therein. Because the bag collapses, there is a lesser tendency for air to enter the bottle as an infant drinks. Ideally, this system helps an infant to swallow less air during feeding than the infant would when feeding from a noncollapsible bottle.

Nevertheless, an air content problem remains with such collapsible bag feeding systems in that during normal filling procedures the collapsible bag cannot be filled completely with liquid. In this regard, such baby nursing bottles initially require that air in the chamber formed by the nipple and the liner cavity be expelled manually prior to the start of feeding. One typical and common method of expelling air is for the user to insert his or her fingers into an open end of a shell body and push on the liner until all of the air is expelled and only liquid remains. While air may be expelled in this manner for a full bottle, as the amount of liquid in the bottle diminishes the liner must be pushed further into the shell from the open lower end of the shell body until the user's fingers can no longer reach the liner to compress the liner and liquid contained therein to expel any captured air.

Bottles have been devised to incorporate mechanical assisting means to force air out of the bottle by physically moving the plastic bag towards the mouthpiece. Such a device is the subject of Holmes, III (U.S. Pat. No. 5,078,287) which utilizes a lower rigid support which is manually slid into the cylinder to force the plastic bag upward. However, the parent must constantly attend to and push the rigid support upward to expel air from the bottle.

The presently used newer generation bottles require that the bottle be in an inverted and nearly vertical position in order to effectively remove the fluid. The liners of most bottles are placed over the neck of the bottle with a ring or cap holding the liner in place. Due to this configuration as well as the flexibility of the liner, the natural tendency of the liner is to collapse upon itself along its longitudinal axis instead of moving upward towards the nipple. Thus, as the fluid is removed from such bottles the flexible liner collapses or flattens upon itself along its longitudinal axis and increasingly narrows the space available for fluid to flow to the nipple. Increasing suction is required to provide an ever decreasing fluid flow.

Due to the natural inclination of the liner to collapse upon itself and constrict fluid flow, the child cannot suck fluid from the bottle while in a vertically erect or standing position. This is an ever increasing concern as the child grows and matures and desires to feed from the bottle in a sitting or standing position. In order to provide a constant fluid flow, the child must horizontally recline or arch his or her neck and back to force the fluid towards the nipple of the inverted bottle. However, even in an inverted position, small pockets of fluid can still be formed within the flattening liner and require a great deal of suction to remove.

The nursing bottles of Phlapahongaphanich (U.S. Pat. No. 4,815,615) and Barton (U.S. Pat. No. 2,876,113) are the only bottles that the inventor is aware of that do not attach the plastic bag over the neck of the bottle. This provides these bottles a degree of liner upward mobility not found with other bottles. However, these devices do not provide sufficient space above the bag to fully accommodate the collapsing bag and thus suffer from the same drawbacks of other newer generation nursing bottles in that the bag collapses longitudinally as previously discussed.

Morever, these nursing bottles allow air to enter into the liner after the bottle has been put aside, particularly in an upright position such as might be the case when the baby is being burped or otherwise attended to. The weight of the liquid in the liner tends to pull the liner downward drawing air into the liner through the nipple. Air may also be drawn into the liner through the nipple or cap when the baby stops sucking for a period of time. Once the bottle is inverted and the infant begins feeding again, the air travels through the liquid and is trapped in a pocket at the top of the inverted bottle. As the fluid is removed, the air pocket remains at the top of the inverted bottle and can be nearly closed off by the liner as the fluid is removed. If the infant continues to suck after the fluid is removed, air is drawn through the nipple and into the infant causing indigestion.

Due to the formation of the air-pocket and flattening of the liner of the bottles of Phlapahongaphanich and Barton, the liner ceases collapsing at or near the point where it is attached to the rigid part of the bottle. The liquid from the nipple to the end of the liner cannot be sucked out of these bottles due to insufficient force, or inadequate vacuum, to fully draw the liner inversely towards the nipple as well as the failure of the liner to fully travel inversely towards the nipple.

Bottles have been devised with a valve incorporated into or otherwise associated with the nipple, such as the bottle of Yamauchi (U.S. Pat. No. 3,651,973). The valve is intended to overcome the problems which are brought about when air enters the bottle. However, Yamauchi has no rigid guide for the liner and as fluid is removed the liner collapses upon itself to create a constriction between portions of the fluid. This is particularly the case if the child sucks when the bottle is not completely inverted. Even in a reclined position, the child must apply a great deal of suction to remove the lower portion of the fluid through the liner constriction and towards the nipple. Due to the constriction and fluid pouch formation due to gravity, the liner cannot fully travel inversely to completely remove the liquid from the bottle. To overcome the longitudinal collapse and constricted fluid flow of the liner, Yamauchi incorporates a sliding lower section which is pushed against the liner to force the fluid upward. While effectively forcing the fluid into contact with the nipple, use of the sliding sections has the same disadvantages as Holmes III in that the parent must periodically push the section upward to avoid constrictions and provide fluid flow.

Further, a variety of modified nursing bottles have been proposed to include a length of flexible tubing extending between the bottle and the nursing nipple. The flexible tubing effectively spaces the nipple from the bottle, with a view toward permitting consumption of the bottle contents without requiring the bottle to be held by the infant or by an adult. In some instances, the tubing terminates at the bottle cap and thus requires support means of some type for retaining the bottle in an inverted position during use. In other designs, the tubing extends through the bottle cap to a position near the bottom of the bottle, and it is intended that the bottle contents be withdrawn by suction while the bottle remains in an upright position.

It has been discovered that conventional nursing nipples of a soft and collapsible construction are generally unsatisfactory for use in nursing bottles of the type having an elongated suction delivery tube connected between the nipple and the interior of the bottle. That is, as the resilient nipple is alternately collapsed and expanded in such bottle designs, the liquid within the bottle is primarily displaced back and forth within the delivery tube, with a minimal quantity of the liquid reaching the infant for consumption. It is believed that the natural inclination of the infant to the collapse and expand the nipple sufficiently disrupts the suction action applied to the delivery tube, whereby little liquid actually reaches the infant in the absence of a significantly increased suction.

In summary, prior drinking dispensers which incorporate a collapsible plastic bag or flexible liner, while presenting numerous advantages over prior nursing bottles, still have disadvantages in their design which require attention. When the drink dispenser is in an upright position and liquid is in the lower part of the flexible/collapsible bag or liner, the upper part of the liner tends to constrict in diameter making it harder to suck liquid out of the bag. Further, as the plastic collapses, it is difficult to tell how much liquid is left in the fluid dispenser or bottle.

Accordingly, there is a need for a simple, straightforward device and drink dispenser construction that permits all of the air to be expelled from the flexible liner and which overcomes the drawbacks noted above. In particular, a fluid dispenser is needed which permits a user to clearly ascertain how much liquid remains in the dispenser (permitting, by easy calculation, how much has been consumed). Moreover, a novel drink dispenser is needed which permits air to be easily expelled from the liner, accommodates pre-filled liners to be sold as a unit with the surrounding dispenser, and allows the user to suck liquid easily and smoothly with the drink dispenser in virtually any orientation. With regard to nursing bottles, a need exists for a fluid dispenser having an elongated flow or delivery tube to accommodate versatile bottle positioning relative to a resilient nipple member, while insuring substantial liquid flow of the liquid to the infant in response to a normal suction action. Such an elongated delivery tube will preferably have approximately the same length as the flexible liner. What is still further needed is a nursing bottle which allows the infant to feed from any angle or position, including an upright standing position. The present invention fulfills these needs and provides other related advantages.

SUMMARY OF THE INVENTION

An improved drink dispenser is provided for facilitating suction-drawn consumption of a beverage or other nutritious liquid therefrom. The drink dispenser comprises, generally, a dispenser body having a hollow interior for receiving a fluid to be consumed and an opening to permit passage of a fluid to be consumed therethrough. A rigid guide tube is fixed to the dispenser body adjacent to the body opening and extends within the drink dispenser from the body opening. A flexible fluid container is sealingly connected or supported relative to a terminal end of the guide tube. The fluid container is adapted to extend away from the guide tube relative to the body opening when filled with fluid to be consumed, and capable of fully collapsing into the guide tube and inversely traveling the length of the guide tube to a point adjacent the opening as the fluid is withdrawn therefrom. The elongated guide tube and the flexible fluid container are approximately the same length.

A casing engages the drink dispenser to enclose the flexible fluid container. The casing is removable to provide selective access to the flexible fluid container. The casing includes an upper casing and a lower casing removably connected to the upper casing. Preferably, the lower casing includes an air vent and is removably connected to the upper casing with a slide-fit connector.

A mouthpiece is placed in fluid-flow communication with fluid contained within the flexible fluid container, and a valve associated with the dispenser body and/or the mouthpiece prevents air-flow from the mouthpiece into the flexible fluid container. The valve also advantageously prevents fluid from inadvertently spilling from the fluid container. The valve may be disposed in a planar dispenser body cap mounted over the dispenser body opening. Means are also provided for expelling air between the valve and the fluid to be consumed within the flexible fluid container, including external pressure exerted upon the flexible fluid container.

In use, after adding liquid to the drink dispenser and positioning the mouthpiece over the opening, the excess air between the mouthpiece and the fluid is expelled by applying external pressure to the flexible fluid container. The liquid is removed through the mouthpiece by sucking. As the fluid is removed, the flexible fluid container collapses into the guide tube until the flexible fluid container inversely travels the length of the guide tube to a point adjacent the opening when the fluid is completely removed.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is a fragmented elevational section of an upper end of an exemplary drink dispenser similar to that illustrated in FIG. 1, illustrating an alternative mouthpiece and inclusion of a dispenser body cap incorporating a one-way valve therein;

FIG. 5 is an enlarged elevational sectional view of the dispenser body cap of FIG. 4;

FIG. 6 is an elevational sectional view similar to FIG. 5 of another, alternative embodiment, dispenser body cap incorporating a one-way slit-valve therein;

FIG. 7 is a top-plan view of the dispenser body cap of FIG. 6, taken generally along the line 7—7 of FIG. 6;

FIG. 8 is an elevational sectional view similar to FIG. 3 illustrating another alternative embodiment of a dispenser body including means for pumping air into the dispenser body so as to pressurize a space between the flexible fluid container and the dispenser body;

FIG. 9 is an elevational sectional view similar to FIGS. 3 and 8, illustrating yet another type of dispenser body wherein the flexible fluid container is sealingly supported between the interface of the upper and lower casings;

DETAILED DESCRIPTION OF THE PREFERRED EMBODIMENTS

Figure 1:
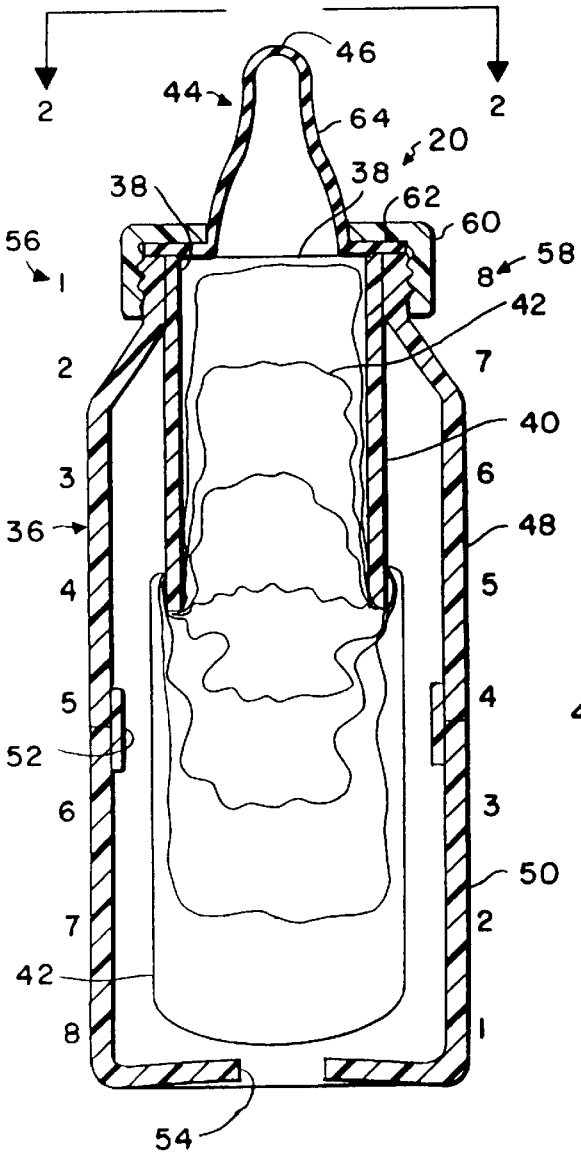
FIG. 1 is an elevational sectional view of a drink dispenser embodying the invention shown in the form of a nursing bottle for infants, illustrating the manner in which a flexible fluid container sealingly connected to a guide tube extends away from the guide tube relative to the body opening when filled with fluid to be consumed, and collapses into the guide tube as the fluid is withdrawn therefrom.
Figure 2:
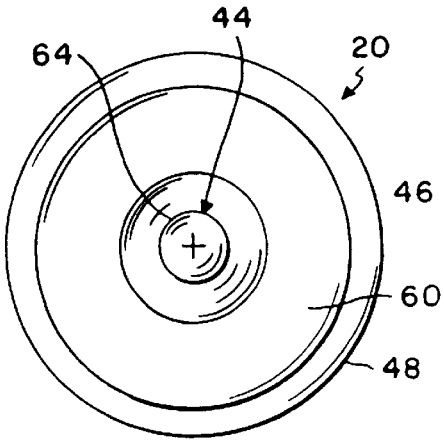
FIG. 2 is a top plan view of the drink dispenser taken generally along the line 2—2 of FIG. 1.
Figure 3:
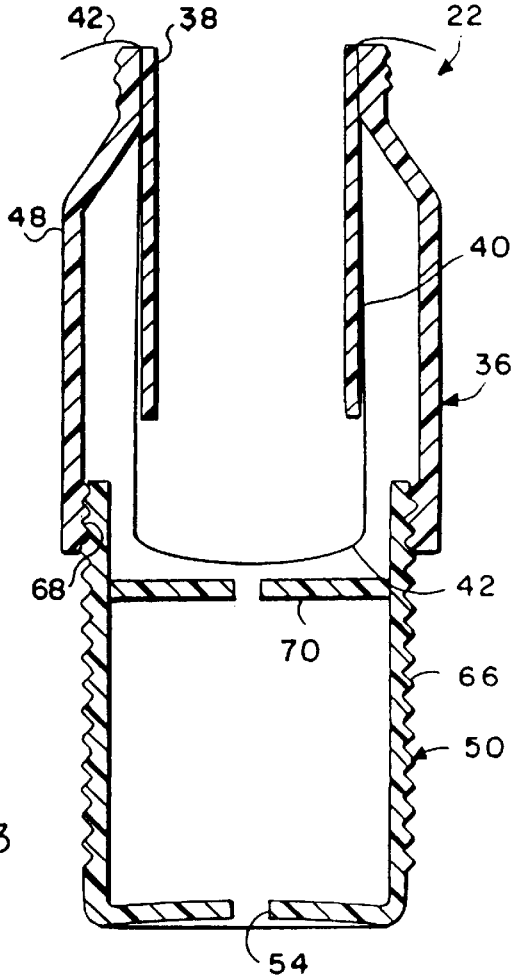
FIG. 3 is similar to FIG. 1 with the exception that a mouthpiece and associated cap have been removed from a dispenser body, and further illustrating an alternative form of dispenser body wherein a lower casing is threadable into an upper casing.
Figure 10:
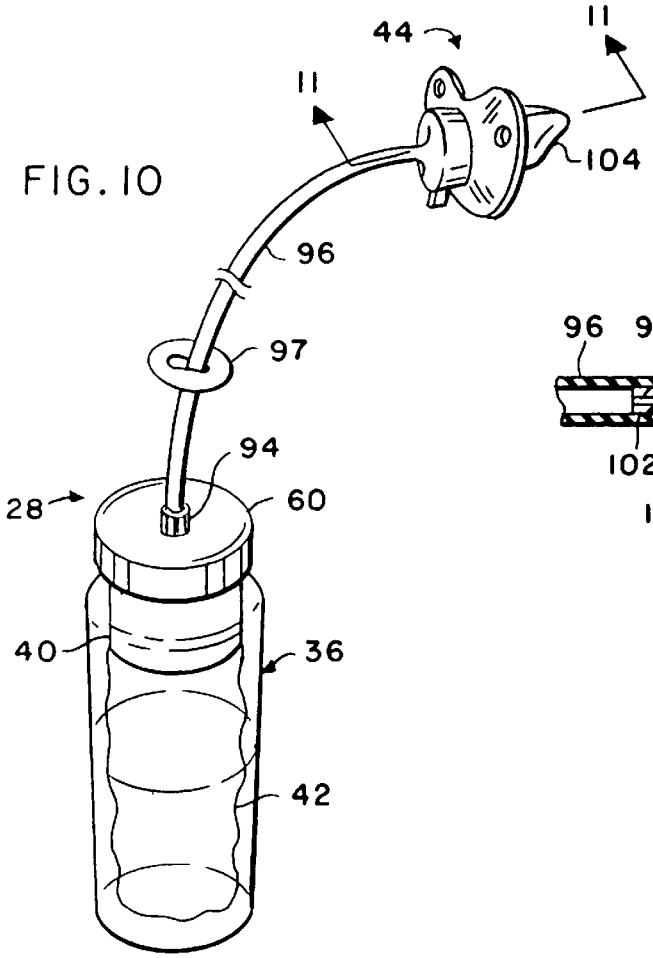
FIG. 10 is a perspective view illustrating a nursing bottle for infants, constructed in accordance with one preferred from of the invention.
Figure 13:
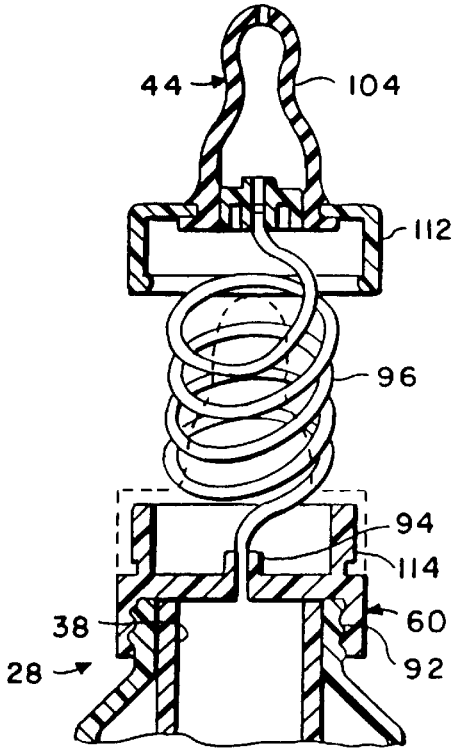
FIG. 13 is an enlarged fragment vertical sectional view illustrating another alternative preferred form of the invention.
Figure 14:
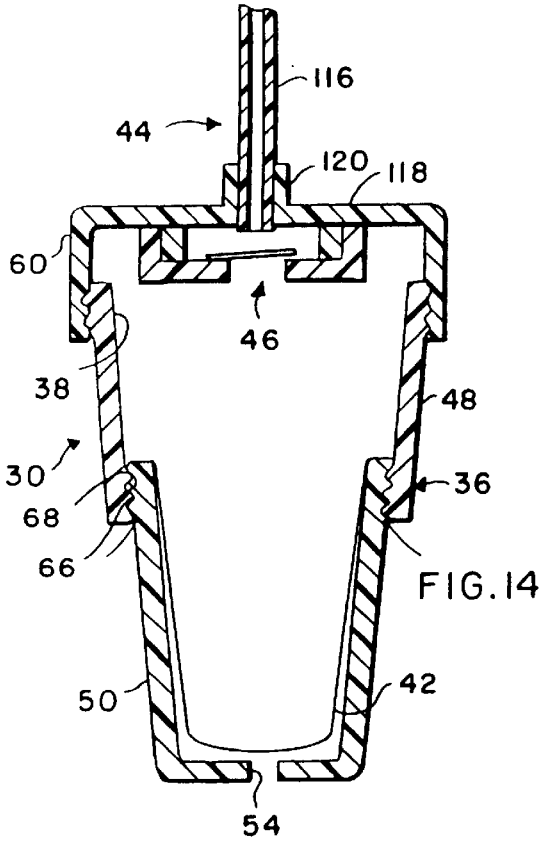
FIG. 14 is an elevational sectional view illustrating another embodiment of the invention wherein a straw is provided through a cap.
Figure 15:
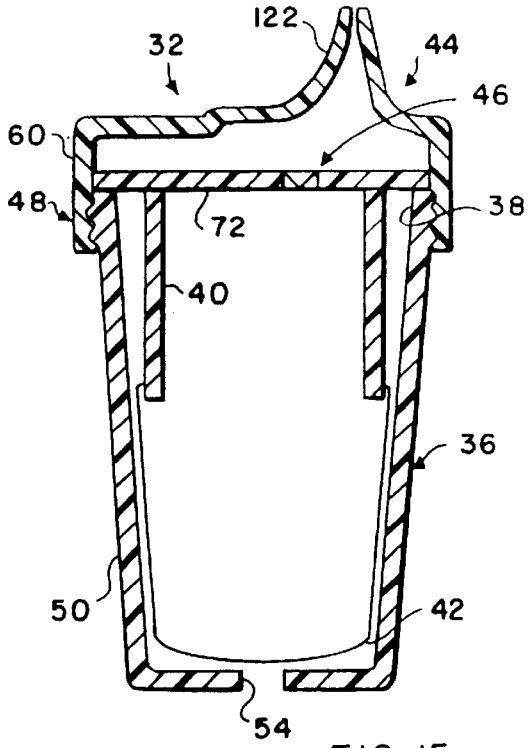
FIG. 15 is an elevational sectional view illustrating another embodiment wherein a conventional spout-type cap is provided.
Figure 16:
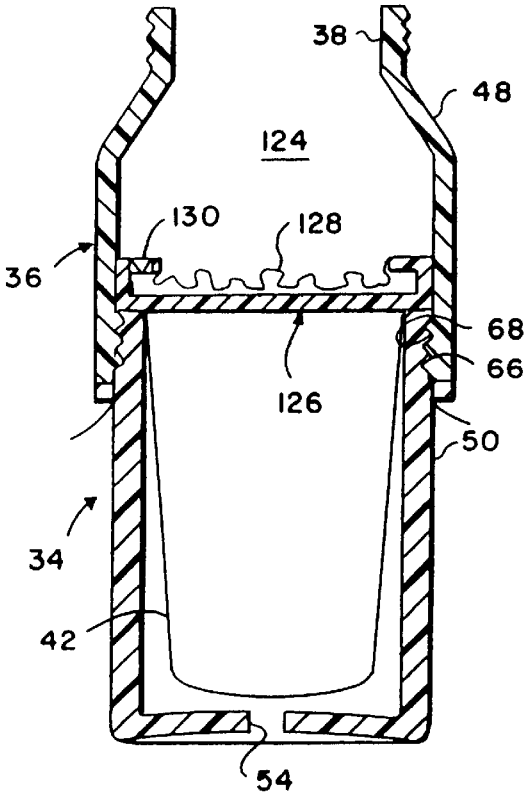
FIG. 16 illustrates another embodiment including an intermediate compartment between the mouthpiece and the flexible fluid container which is disposed within the dispenser body such that fluid to be consumed disposed within the flexible fluid container must pass through the intermediate compartment prior to passing through the mouthpiece.

As shown in the drawings for purposes of illustration, the present invention is concerned with a drink dispenser, referred to generally in FIGS. 1 and 2 by the reference number 20, in FIGS. 3 and 4 by the reference number 22, in FIG. 8 by the reference number 24, in FIG. 9 by the reference number 26, in FIGS. 10 and 13 by the reference number 28, in FIG. 14 by the reference number 30, in FIG. 15 by the reference number 32, and in FIG. 16 by the reference number 34. In each of the illustrated embodiments of the drink dispenser 20–34, functionally equivalent components will be given the same reference number.

Each drink dispenser 20 comprises, generally, a dispenser body 36 that has an upper opening 38 to permit passage of a fluid to be consumed therethrough, and a rigid guide tube 40 which extends downwardly from the body opening 38. A flexible fluid container 42 is sealingly connected to the guide tube 40 and is adapted to extend away from the guide tube relative to the body opening 38 when filled with the fluid to be consumed, and collapse into the guide tube as the fluid is withdrawn therefrom. A mouthpiece 44 is provided in fluid-flow communication with fluid contained within the flexible fluid container 42, and a one-way valve 46 is provided in association with either the body opening 38 or the mouthpiece 44, to prevent air-flow from the mouthpiece 44 into the flexible fluid container 42.

With reference to FIGS. 1 and 2, the dispenser body 36 has a hollow interior and the rigid guide tube 40 extends within the dispenser body from the body opening 38. The dispenser body 36 comprises an upper casing 48 to which the guide tube is fixed, a lower casing 50, and means for connecting the lower casing to the upper casing. In this particular case, the connection means is a slide-fit connector 52 that permits the lower casing 50 to be joined to the upper casing 48 by a friction fit. The flexible fluid container 42 is sealed to a lower end of the guide tube 40 and, when filled with the fluid to be consumed, may extend substantially the entire length of the dispenser body 36. The lower end of the lower casing 50 is provided an air vent 54 which allows equalization of air pressure within the dispenser body 36 as fluid is consumed and the volume of the flexible fluid container 42 within the dispenser body 36 decreases.

Two sets of numbers, one ascending and the other descending, 56 and 58 are provided on the exterior of the dispenser body 36, which is preferably transparent. These numbers are provided to permit the user of the drink dispenser 20 to ascertain the amount of fluid within the dispenser body 36. For example, when filling the flexible fluid container 42 with a fluid to be consumed, the drink dispenser 20 may be held upright and the ascending numbers 56 read to determine the number of fluid ounces within the flexible fluid container 42. Alternatively, or after air has been removed from the space between the one-way valve 46 and any fluid within the flexible fluid container 42 and guide tube 40, the drink dispenser 20 may be inverted and the descending numbers 58 read to determine precisely the amount of fluid to be consumed that remains in the drink dispenser 20.

The upper end of the upper casing 48 is threaded to receive a bottle cap 60 which, when threaded onto the upper casing 48, compresses an outer flange 62 of a standard nipple 64 that forms the mouthpiece of 44 referred to above. The one-way valve 46 is incorporated into the end of the nipple 64 and, as shown in FIG. 2, comprises a slit valve.

In use, the mouthpiece 44, comprising the bottle cap 60 and the nipple 64, is removed from the upper casing 48 to expose the body opening 38. Fluid to be consumed is poured into the flexible fluid container 42 through the body opening 38. When the desired amount of fluid to be consumed has been placed into the dispenser body 36, the mouthpiece is replaced atop the upper casing 48, and then the flexible fluid container 42 is manually squeezed, while holding the drink dispenser 20 upright, to force the fluid level of the fluid to be consumed upwardly toward the end of the nipple 64 where the one-way valve 46 is situated. This serves to remove all air from the space between the one-way valve 46 and the fluid to be consumed, as is often desirable. This manual squeezing of the flexible fluid container 42 is facilitated by removing the lower casing 50 from the slide fit connector 52. Once the air is removed, the lower casing 50 may be replaced onto the upper casing 48.

FIGS. 3 and 4 illustrate an alternate embodiment of the drink dispenser 22, wherein the lower casing 50 includes external threads 66 that may engage internal threads 68 disposed at a lower end of the upper casing 48. A plate 70 is provided within the lower casing 50 to engage a lower end of the flexible fluid container 42 so that as the lower casing 48 is threaded into the upper casing 48, the plate 70 may engage a lower end of the flexible fluid container 42 to press it upwardly for purposes of expelling unwanted air from within the dispenser body 36. In this case, the flexible fluid container 42 extends from the body opening 38 downwardly beyond the lower end of the rigid guide tube 40.

As illustrated in FIG. 4, the positioning of the one-way valve 46 is also different than that illustrated in FIGS. 1 and 2. Here, a dispenser body cap 72 is mounted over the dispenser body opening 38, and the one-way valve 46 is disposed in the dispenser body cap 72. The dispenser body cap of FIGS. 4 and 5 includes a central aperture 74 and a flap valve 76. Alternatively, as illustrated in FIGS. 6 and 7, the dispenser body cap 72 may be provided with a central passageway 78 defined by a slit valve 80.

FIG. 8 illustrates another drink dispenser 24 wherein the lower casing 50 telescopes into the upper casing 48 to provide a pump-type action for purposes of pressurizing the space between the guide tube 40 and the flexible fluid container 42, on the one hand, and the inner surfaces of the upper casing 48, on the other. More particularly, the lower end of the upper casing 48 is closed by means of an inverted u-shaped intermediate structure 82. A central aperture 84 is provided through an upper end of the intermediate structure 82, and a flap valve 86 is associated therewith to provide a means for one-way air flow therethrough. The lower end of the intermediate structure 82 has an o-ring 88 which engages an exterior surface of the lower casing 50 to provide a seal therebetween. The lower casing 50 extends upwardly into the intermediate structure 82 and is capable of being moved, in a reciprocal fashion, upwardly and downwardly within the intermediate structure 82. The air vent 54 is provided with a flap valve 90 to provide only unidirectional flow through the air vent 54.

In use, as the lower casing 50 is alternatively pulled and pushed upwardly and downwardly into the intermediate structure 82, air is pumped through the central aperture 84 into the space within the upper casing 48 surrounding the guide tube 40 and the flexible fluid container 42. By pressurizing this space, fluid to be consumed within the flexible fluid container 42 is forced upwardly through the guide tube 40 for purposes of expelling unwanted air adjacent to an upper surface of the fluid to be consumed.

FIG. 9 illustrates yet another embodiment of the drink dispenser 26, wherein the upper casing 48 functions as the guide tube 40, and the upper end of the flexible fluid container 42 is disposed between the external and internal threads 66 and 68 of the lower and upper casings 50 and 48.

In use, excess air between the mouthpiece 44 and the fluid to be consumed is first expelled. This is typically accomplished by applying external pressure to the flexible fluid container 42. One way of applying external pressure is to remove the lower casing 50 and squeeze the flexible fluid container 42 until the air is expelled through the mouthpiece 44. The valve 46 prevents air from entering back into the drink dispenser 20-26. The liquid is removed from the drink dispenser by sucking the fluid through the mouthpiece 44. As the fluid to is consumed, the flexible fluid container 42 collapses into the guide tube 40. The flexible fluid container 42 travels the length of the guide tube as fluid is removed, until reaching a point adjacent the opening 38, as illustrated in FIG. 1.

With reference to FIG. 10, the drink dispenser 28 comprises a nursing bottle that provides for facilitated suction delivery of a beverage or other nutritious liquid to an infant (not shown). The improved nursing bottle 28 includes a hollow bottle body 36 of relatively conventional geometry, in combination with a mouthpiece 44 through which the beverage or the like can be suction-drawn for consumption. The mouthpiece 44 provides a soft and resilient or natural feel to the infant, while making possible a substantially improved suction-induced liquid flow.

The bottle body 36 has a generally standardized construction and size to include an open bottle mouth 38 defined by a cylindrical and externally threaded neck 92. The beverage or the like may thus be introduced into the flexible fluid container 42 via the open mouth 38, followed by thread-on mounting of a cap 60. The cap 60 has a central flow port 94 formed therein for accommodating in-line connection of the flow port 94 with a flow tube 96.

The flow tube 96 is constructed from flexible plastic tubing or the like. The flow tube 96 extends between the bottle cap 60 and the mouthpiece 44 to space the mouthpiece 44 from the bottle body 36 by a substantial distance, typically on the order of one to two feet, and thereby permits the bottle to be placed alongside an infant in an upright or inverted position during nursing. A clamp 97 is provided to close the flow tube to fluid flow therethrough when desired, and may serve the function of the valve 44 discussed above.

Figure 11:
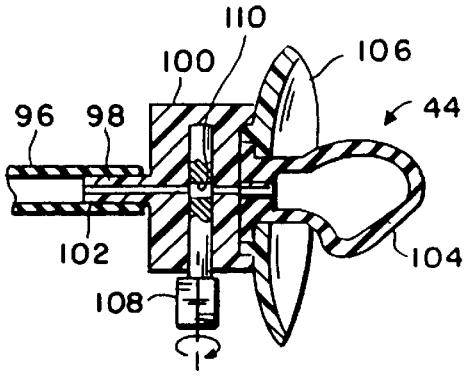
FIG. 11 is an enlarged fragmented sectional view taken generally on the line 11—11 of FIG. 10.
Figure 12:
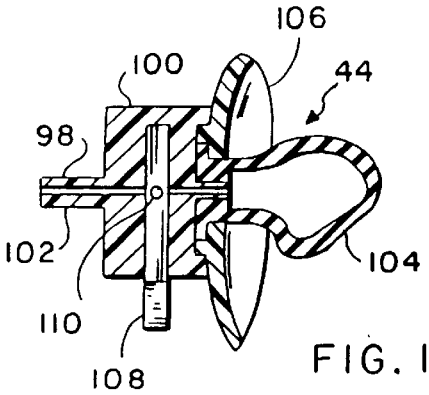
FIG. 12 is a sectional view similar to FIG. 11, and illustrating alternative use of the mouthpiece shown therein.

FIGS. 11 and 12 show the mouthpiece 44 in one preferred form, constructed generally in the configuration of a standard pacifier. More specifically, the outer or distal end of the flow tube 96 is fitted onto a tubular post 98 on a valve block 100 having a suction fluid flow path 102 formed therethrough. The valve block 100 supports a soft and resilient nipple member 104, preferably in association with a plastic guard or shield 106. A valve member 108 is carried by the valve block 100 for rotation between a normal open position with a valve aperture 110 aligned with the flow path 102 (FIG. 11), and a closed position with the valve aperture 110 extending transversely with respect to the flow path 102 (FIG. 12).

The mouthpiece 44 shown in FIGS. 11 and 12 is conveniently adapted for alternative use as a pacifier. In this regard, the flow tube 96 can be disconnected from the valve block 100 quickly and easily, to permit independent use of the mouthpiece 44 apart from the remainder of the nursing bottle components. When pacifier use is desired, the valve member 108 is rotated to the closed position (FIG. 12) to prevent the infant from sucking air through the flow path 102.

FIG. 13 shows a further variation on the invention, wherein the nipple member 104 is mounted onto a cap base 112 adapted for removable snap-on mounting onto a modified bottle cap 60 having a snap-fit mounting ring 114. In this configuration, the flow tube 96 connected between the cap 60 and the nipple member 104 comprises a length of coiled tubing which can be stored in a coiled state between the cap base 112 and cap 60, or extended when the cap base 112 is removed from the bottle for use.

FIG. 14 illustrates yet another drink dispenser 30 having a dispenser body 36 similar to that illustrated in FIG. 9. The mouthpiece 44, however, has been replaced with a mechanism for receiving a straw 116. To accomplish this, the upper end of the upper casing 48 is threaded to receive a cap 118 that has been modified to accept the straw 116. A one-way valve 46 is incorporated into the cap 118 immediately adjacent to a central flow port 120 through which the straw 116 is extended. In this embodiment, as well as those of FIGS. 9, 15 and 16, the lower casing 50 is preferably formed of a resiliently deformable elastomeric material that permits the lower casing to be squeezed in order to engage the flexible fluid container 42 to force unwanted air out of the dispenser body 36.

FIG. 15 is another illustration of an alternative embodiment, wherein the cap 118 has been modified to include a drinking spout 122.

FIG. 16 illustrates yet another alternative embodiment wherein an intermediate compartment 124 is provided between the mouthpiece (not shown) and the flexible fluid container 42. The intermediate compartment 124 is disposed within the dispenser body 36 such that the fluid to be consumed disposed within the flexible fluid container must pass through the intermediate compartment 124 prior to passing through the body opening 38 and the mouthpiece 44. In this embodiment, the flexible fluid container 42 is supported at its upper end between the internal and external threads 68 and 66 of the upper and lower casings 48 and 50. A removable dividing structure 126 may be provided over the upper end of the lower casing 50 to prevent passage of liquid from the flexible fluid container 42 to the intermediate compartment 124. When the dividing structure 126 is removed, the fluid to be consumed within the flexible fluid container 42 is separated from the contents of the intermediate compartment 124 by a fluid impervious membrane 128 and an intermediate one-way valve 130. As the lower casing 50 is squeezed to force fluid to be consumed upwardly, it passes through the intermediate one-way valve 130 for mixing with whatever might be contained within the intermediate compartment, such as a flavoring agent, powder, etc., for mixing with the fluid to be consumed.

From the foregoing it will be appreciated that the present invention provides a convenient drink dispenser wherein unwanted air within the dispenser may be easily removed to permit fluid to be consumed therein to be easily and smoothly withdrawn, such as by sucking on an appropriate mouthpiece. The above-described embodiments are advantageous over existing nursing bottles using collapsible plastic bags as the flexible fluid container 42 actually travels upwardly and into the guide tube 40. This movement prevents the longitudinal collapse found in existing bottles and the premature capture of fluid in pockets which require forceful sucking to remove. A further advantage to the present invention is the elimination of excess air from within the drink dispenser 20–34. The amount of fluid to be consumed may be easily read on the exterior of the drink dispenser. The design of the drink dispenser 20–34 further allows the child or infant to drink from the dispenser 20–34 while in an erect or standing position, which is not possible with existing bottles.

Although several particular embodiments of the invention have been described in detail for purposes of illustration, various modifications of each may be made without departing from the spirit and scope of the invention. Accordingly, the invention is not to be limited, except as by the appended claims.

I claim:

1. A drink dispenser, comprising:

a dispenser body having a hollow interior for receiving a fluid to be consumed, and an opening to permit passage of the fluid to be consumed therethrough;

an elongated rigid guide tube fixed to the dispenser body adjacent the body opening so as to extend within the dispenser body from the body opening;

a flexible fluid container supported relative to a terminal end of the elongated guide tube and adapted to extend away from the elongated guide tube relative to the body opening when filled with fluid to be consumed, and capable of fully collapsing into and traveling the length of the elongated guide tube to a point adjacent to the body opening as the fluid is withdrawn therefrom, wherein the elongated guide tube and the flexible fluid container are approximately the same length; and a casing which engages the dispenser body to enclose the flexible fluid container.

2. The drink dispenser of claim 1, wherein the casing is removable to permit selective access to the flexible fluid container.

3. The drink dispenser of claim 2, wherein the casing includes an upper casing and a lower casing.

4. The drink dispenser of claim 3, wherein the lower casing is removably connected to the upper casing with a slide-fit connector.

5. The drink dispenser of claim 2, wherein the lower casing includes an air vent.

6. The drink dispenser of claim 2, including a mouthpiece in fluid flow communication with fluid contained within the flexible fluid container, and a valve associated with the mouthpiece for preventing air-flow from the mouthpiece into the flexible fluid container.

7. The drink dispenser of claim 6, including a substantially planar dispenser body cap having the valve disposed therein and mounted over the dispenser body opening.

8. The drink dispenser of claim 6, including means for expelling air between the valve and the fluid to be consumed within the flexible fluid container comprising external pressure exerted upon the flexible fluid container.

9. A drink dispenser, comprising:

a dispenser body having a hollow interior for receiving a fluid to be consumed, and an opening to permit passage of the fluid to be consumed therethrough;

an elongated rigid guide tube fixed to the dispenser body adjacent to the body opening so as to extend within the dispenser body from the body opening;

a flexible fluid container supported relative to a terminal end of the elongated guide tube and having approximately the same length as the rigid guide tube, the a casing which engages the dispenser body to enclose the flexible fluid container, the casing being removable to permit selective access to the flexible fluid container, wherein the casing includes an upper casing and a lower casing, the lower casing being removably connected to the upper casing with a slide-fit connector, and wherein the lower casing includes and air vent.

10. The drink dispenser of claim 9, including a substantially planar dispenser body cap having a valve disposed therein and mounted over the dispenser body opening.

11. The drink dispenser of claim 9, including means for expelling air between the valve and the fluid to be consumed within the flexible fluid container comprising external pressure exerted upon the flexible fluid container.

12. A drink dispenser, comprising:

a dispenser body having a hollow interior for receiving a fluid to be consumed, and an opening to permit passage of the fluid to be consumed therethrough;

an elongated rigid guide tube fixed to the dispenser body adjacent the body opening so as to extend within the dispenser body from the body opening;

a flexible fluid container supported relative to a terminal end of the elongated guide tube and adapted to extend away from the elongated guide tube relative to the body opening when filled with fluid to be consumed, and capable of fully collapsing into and traveling the length of the elongated guide tube to a point adjacent to the body opening as the fluid is withdrawn therefrom; and a casing which engages the dispenser body to enclose the flexible fluid container, the casing being removable to permit selective access to the flexible fluid container, wherein the casing includes an upper casing and a lower casing, the lower casing being removably connected to the upper casing with a slide-fit connector, and wherein the lower casing includes and air vent.

13. The drink dispenser of claim 12, wherein the elongated guide tube and the flexible fluid container are approximately the same length.

14. The drink dispenser of claim 12, including a mouthpiece in fluid flow communication with fluid contained within the flexible fluid container, and a valve associated with the mouthpiece for preventing air-flow from the mouthpiece into the flexible fluid container.

15. The drink dispenser of claim 14, including a substantially planar dispenser body cap having the valve disposed therein and mounted over the dispenser body opening.

16. The drink dispenser of claim 14, including means for expelling air between the valve and the fluid to be consumed within the flexible fluid container comprising external pressure exerted upon the flexible fluid container.

* * * * *

UNITED STATES PATENT AND TRADEMARK OFFICE

CERTIFICATE OF CORRECTION

PATENT NO. : 6,253,936 B1
DATED : July 3, 2001
INVENTOR(S) : Carl Cheung Tung Kong It is certified that error appears in the above-identified patent and that said Letters Patent is hereby corrected as shown below:

Claim 9,
Line 56, delete [a casing which engages the dispenser body to enclose the]

Signed and Sealed this

Fifth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,253,936 B1
APPLICATION NO. : 09/478964
DATED : July 3, 2001
INVENTOR(S) : Carl Cheung Tung Kong It is certified that error appears in the above-identified patent and that said Letters Patent is hereby corrected as shown below:

In col. 10, lines 55-61, delete "a casing which engages the dispenser body to enclose the flexible fluid container, the casing being removable to permit selective access to the flexible fluid container, wherein the casing includes an upper casing and a lower casing, the lower casing being removably connected to the upper casing with a slide-fit connector, and wherein the lower casing includes and air vent."

In col. 10, line 55, add:

-- flexible fluid container being adapted to extend away from the elongated guide tube relative to the body opening when filled with fluid to be consumed, and capable of fully collapsing into and traveling the length of the elongated guide tube to a point adjacent to the dispenser body opening as the fluid is withdrawn therefrom; a casing removably connected to the dispenser body to enclose the flexible fluid container and permit selective access to the flexible fluid container, the casing including an upper casing and a lower casing, wherein the lower casing includes an air vent and is removably connected to the upper casing with a slide-fit connector; and a mouthpiece in fluid flow communication with fluid contained within the flexible fluid container,

UNITED STATES PATENT AND TRADEMARK OFFICE

CERTIFICATE OF CORRECTION

PATENT NO. : 6,253,936 B1
APPLICATION NO. : 09/478964
DATED : July 3, 2001
INVENTOR(S) : Carl Cheung Tung Kong It is certified that error appears in the above-identified patent and that said Letters Patent is hereby corrected as shown below:

In col. 10, line 55, add: (cont'd)

and a valve associated with the mouthpiece for preventing air-flow from the mouthpiece into the flexible fluid container.--

Signed and Sealed this

Seventeenth Day of April, 2007

JON W. DUDAS
*Director of the United States Patent and Trademark Office*